US007344227B2

(12) United States Patent
King et al.

(10) Patent No.: US 7,344,227 B2
(45) Date of Patent: Mar. 18, 2008

(54) POWER AND GROUND BUSS LAYOUT FOR REDUCED SUBSTRATE SIZE

(75) Inventors: David G. King, Shelbyville, KY (US); Kristi M. Rowe, Richmond, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 11/676,551

(22) Filed: Feb. 20, 2007

(65) Prior Publication Data

US 2007/0139475 A1 Jun. 21, 2007

Related U.S. Application Data

(62) Division of application No. 10/956,939, filed on Sep. 30, 2004, now Pat. No. 7,195,341.

(51) Int. Cl.
*B41J 2/05* (2006.01)

(52) U.S. Cl. ..... 347/57; 347/58

(58) Field of Classification Search ..... 347/57, 347/58, 56; 257/207, 210, 211, 337, 691
See application file for complete search history.

(56) References Cited

U.S. PATENT DOCUMENTS

| | | | |
|---|---|---|---|
| 4,458,256 | A | 7/1984 | Shirato et al. |
| 4,887,098 | A | 12/1989 | Hawkins et al. |
| 4,935,752 | A | 6/1990 | Hawkins |
| 4,985,710 | A | 1/1991 | Drake et al. |
| 5,030,971 | A | 7/1991 | Drake et al. |
| 5,144,341 | A | 9/1992 | El Haten et al. |
| 5,159,353 | A | 10/1992 | Fasen et al. |
| 5,469,199 | A | 11/1995 | Allen et al. |
| 5,600,354 | A | 2/1997 | Hackleman et al. |
| 5,635,966 | A | 6/1997 | Keefe et al. |
| 5,644,342 | A | 7/1997 | Argyres |
| 5,666,142 | A | 9/1997 | Fujita et al. |
| 5,835,112 | A | 11/1998 | Whitlock et al. |
| 5,883,650 | A | 3/1999 | Figueredo et al. |
| 5,933,161 | A | 8/1999 | Sato et al. |
| 6,019,907 | A | 2/2000 | Kawamura |
| 6,153,114 | A | 11/2000 | Figueredo et al. |

(Continued)

FOREIGN PATENT DOCUMENTS

EP 0317171 A2 5/1989

*Primary Examiner*—Lamson Nguyen
(74) *Attorney, Agent, or Firm*—Luedeka, Neely & Graham PC

(57) ABSTRACT

A semiconductor substrate for a micro-fluid ejection device. The substrate includes plurality of micro-fluid ejection actuators disposed adjacent a fluid supply slot in the semiconductor substrate. A plurality of power transistors, occupying a power transistor active area of the substrate, are disposed adjacent the ejection actuators and are connected through a first metal conductor layer to the ejection actuators. An array of logic circuits, occupying a logic circuit area of the substrate, is disposed adjacent the plurality of power transistors and is connected through a polysilicon conductor layer to the power transistors. A power conductor and a ground conductor for the ejection actuators is routed in a second metal conductor layer. The power conductor overlaps at least a portion of the power transistor active area of the substrate and the ground conductor overlaps at least a portion of the logic circuit area of the substrate.

9 Claims, 7 Drawing Sheets

U.S. PATENT DOCUMENTS 6,200,407 B1 * 3/2001 Wieloch et al. ..... 156/252
6,227,657 B1 5/2001 Raisanen et al.
6,239,820 B1 5/2001 Figueredo et al.
6,305,790 B1 10/2001 Kawamura et al.
6,309,053 B1 10/2001 Torgerson et al.
6,350,017 B1 2/2002 Kamada
6,402,302 B1 6/2002 Ozaki et al.
6,422,676 B1 7/2002 Torgerson et al.
6,543,883 B1 4/2003 Dodd et al.
6,554,404 B2 4/2003 Giere et al.
6,565,175 B1 5/2003 Scardovi et al.
6,575,562 B1 6/2003 Anderson et al.
6,726,311 B2 4/2004 Torgerson et al.
6,787,050 B2 9/2004 Parish
2002/0020921 A1 2/2002 Wang et al.
2002/0048943 A1 4/2002 Wang et al.
2002/0105009 A1 * 8/2002 Eden et al. ..... 257/138
2003/0011658 A1 1/2003 Parish
2003/0107616 A1 6/2003 Huang et al.
2003/0210301 A1 11/2003 Seabridge et al.

* cited by examiner

POWER AND GROUND BUSS LAYOUT FOR REDUCED SUBSTRATE SIZE

RELATED APPLICATIONS

This application is a division of application Ser. No. 10/956,939, filed Sep. 30, 2004 now U.S. Pat. No. 7,195,341 now allowed.

FIELD OF THE DISCLOSURE

The disclosure relates to micro-fluid ejection head substrates and in particular to improved conductor layouts for reduced substrate size.

BACKGROUND

Micro-fluid ejection devices continue to be used in a wide variety of applications, including ink jet printers, medical delivery devices, micro-coolers and the like. Of the uses, ink jet printers provide, by far, the most common use of micro-fluid ejection devices. Ink jet printers are typically more versatile than laser printers for some applications. As the capabilities of ink jet printers are increased to provide higher quality images at increased printing rates, fluid ejection heads, which are the primary printing components of ink jet printers, continue to evolve and become more complex.

As the complexity of micro-fluid ejection devices increases, there is a need to include more functions on semiconductor substrates for the devices. However, there is a competing need to maintain or reduce the size of the substrates so as to minimize the cost of the ejection devices. While miniaturization provides benefits relative to material costs, such miniaturization may also have negative effects on operational properties of the devices. For example, reducing the size of ground and power busses on the substrate may enable smaller size substrates to be used. However, reduced size busses usually have higher resistance and thus generate more heat than larger busses. Hence, there continues to be a need for improved substrate conductor routing and layouts that do not adversely affect the electrical properties of the circuits.

SUMMARY

With regard to the above and other objects and advantages, the disclosure provides a semiconductor substrate for a micro-fluid ejection device. The substrate includes plurality of micro-fluid ejection actuators disposed in a columnar array adjacent a fluid supply slot in the semiconductor substrate. A plurality of power transistors are disposed in a columnar array adjacent the ejection actuators and are connected through a first metal conductor layer to the ejection actuators. The columnar array of power transistors occupies a power transistor active area of the substrate. A columnar array of logic circuits is disposed adjacent the columnar array of power transistors and is connected through a polysilicon conductor layer to the power transistors. The columnar array of logic circuits occupies a logic circuit area of the substrate. A power conductor for the ejection actuators is routed in a second metal conductor layer and is disposed in overlapping relationship with at least a portion of the power transistor active area of the substrate. A ground conductor for the ejection actuators is routed in the second metal conductor layer and is disposed in overlapping relationship with at least a portion of the logic circuit area of the substrate.

In another embodiment, there is provided a method for reducing a width of a semiconductor substrate for a micro-fluid ejection device. The method includes providing at least one fluid supply slot in a semiconductor substrate. A plurality of micro-fluid ejection actuators are in a columnar array on a device surface of a semiconductor substrate adjacent the fluid supply slot. A plurality of power transistors are formed in a columnar array adjacent the ejection actuators. The power transistors occupy a power transistor area of the substrate and are interconnected to the ejection actuators in a first metal conductor layer. A columnar array of logic circuits are formed adjacent the power transistors. The logic circuits occupy a logic circuit area of the substrate and are interconnected to the power transistors in a polysilicon conductor layer. A second metal layer is deposited on the semiconductor substrate to provide a power buss and a ground buss to the ejection actuators. The power buss overlaps a least a portion of the power transistor active area and the ground buss overlaps at least a portion of the logic circuit area.

An advantage of the embodiments of the disclosure is that it provides suitably sized power and ground buss conductors for components on a semiconductor substrate without the need to increase the size of the substrate or surface area available for routing the power and ground busses. For example, the power and ground buss conductors may be provided with a size that does not adversely affect resistance values of the conductors to fluid ejection actuators on the substrate thereby providing more energy to the fluid ejection actuators. Another advantage of the embodiments is that it provides polysilicon interconnections between selected components without adversely affecting the timing of firing pulses for the fluid ejection actuators.

BRIEF DESCRIPTION OF THE DRAWINGS

Further advantages of the disclosed embodiments will become apparent by reference to the detailed description of preferred embodiments when considered in conjunction with the following drawings illustrating one or more non-limiting aspects of the embodiments, wherein like reference characters designate like or similar elements throughout the several drawings as follows.

DETAILED DESCRIPTION OF THE PREFERRED EMBODIMENTS

Figure 1:
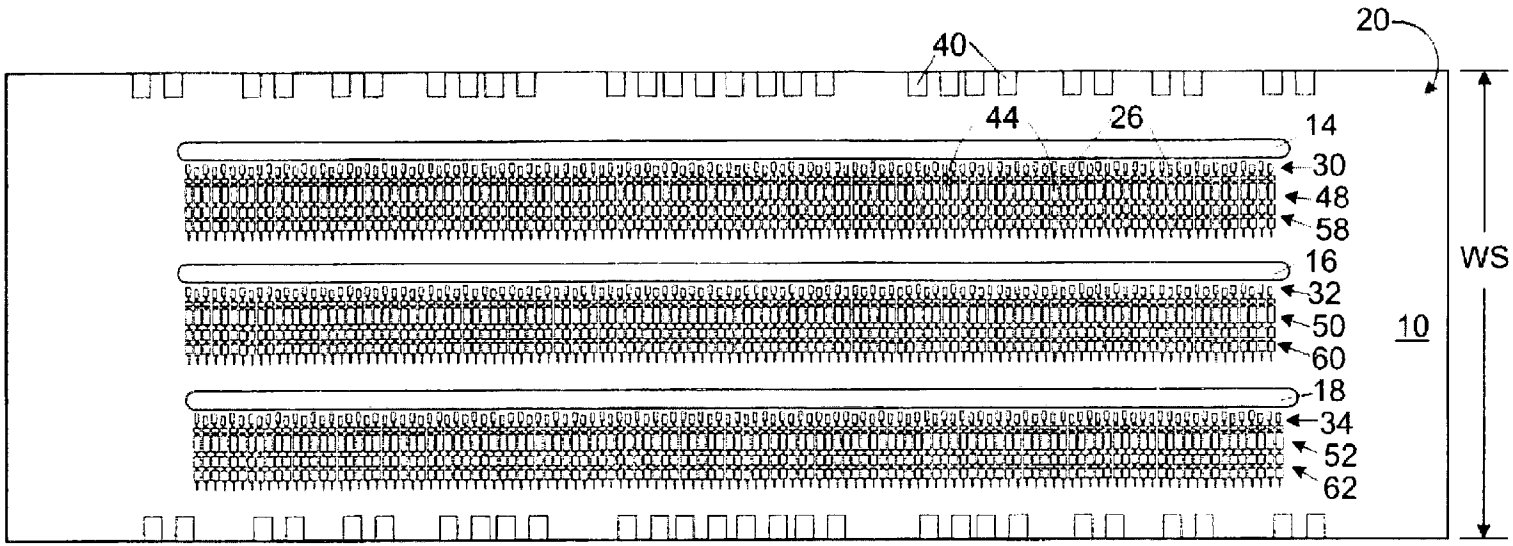
FIGS. 1 and 2 are plan views, not to scale, of semiconductor substrates for micro-fluid ejection heads according to the disclosure.
Figure 2:
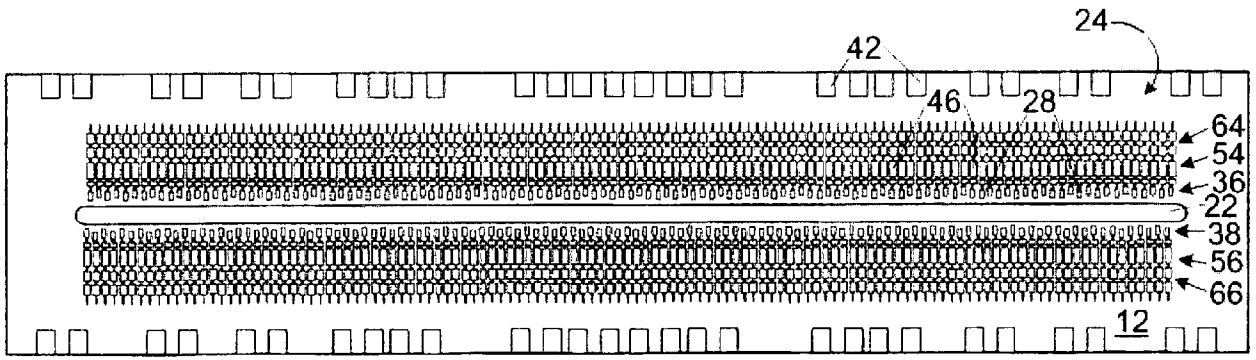

With reference to FIGS. 1 and 2, embodiments of the disclosure provide improved semiconductor substrates 10 and 12. Substrate 10, for example, may include three fluid supply slots 14, 16, and 18 therethrough for flow of fluid from an opposite surface of the substrate 10 to a device surface 20 of the substrate 10. Substrate 12 may include a single fluid supply slot 22 for flow of fluid from an opposite surface to a device surface 24 of the substrate 12. The device surfaces 20 and 24 include a plurality of fluid ejection actuators 26 and 28 disposed in substantially columnar arrays 30, 32, and 34 on substrate 10 and in columnar arrays 36 and 38 on substrate 12. For substrate 10, the ejection actuators 26 are disposed adjacent the fluid supply slots 14, 16, and 18 on at least one side thereof as illustrated. However, the ejection actuators may be disposed on both sides of the fluid supply slots 14, 16, and 18.

For substrate 12, the ejection actuators 28 are disposed adjacent the fluid supply slot 22 on opposing sides thereof. Contact pads 40 and 42 are disposed on the surfaces 20 and 24 of the substrates 10 and 12 for electrical connection to a control device for activating the actuators.

In order to selectively activate certain ones of the ejection actuators 26 or 28, driver and control logic are also included on the device surfaces 20 and 24 of the substrate. The control logic includes power and ground interconnections in a first metal conductor layer. The driver logic includes power transistors 44 and 46 for providing energy to the ejection actuators 26 and 28 respectively. As will be described in more detail below, the power transistors 44 and 46 are connected through the first metal conductor layer to the ejection actuators 26 and 28. Like the ejection actuators 26 and 28, the power transistors 44 and 46 are included in columnar arrays 48, 50, and 52 adjacent the arrays 30, 32, and 34 of actuators 26 on the substrate 10 and in columnar arrays 54 and 56 adjacent the arrays 36 and 38 of actuators 28 on substrate 12.

Control logic arrays 58, 60, and 62 are disposed adjacent the power transistors 44 and control logic arrays 64 and 66 are disposed adjacent the power transistors 46. Interconnection between the control logic arrays 58-66 and the power transistors 44 and 46 is in a polysilicon layer rather than in the first metal conductor layer or in a second metal conductor layer thereby eliminating the need for a three metal layer process for providing interconnections and power and ground buss routing to the devices.

In general, polysilicon interconnections are less desirable than metal interconnections due to a higher resistance of the polysilicon interconnections than in metal interconnections. Higher resistance may lead to actuator timing problems particularly with respect to interconnections between the power transistors 44 and 46 and the ejection actuators 26 and 28. However, embodiments of the disclosure circumvent such timing problems by using polysilicon interconnections only between the control logic arrays 58-66 and the power transistor arrays 48-56.

Figure 3:
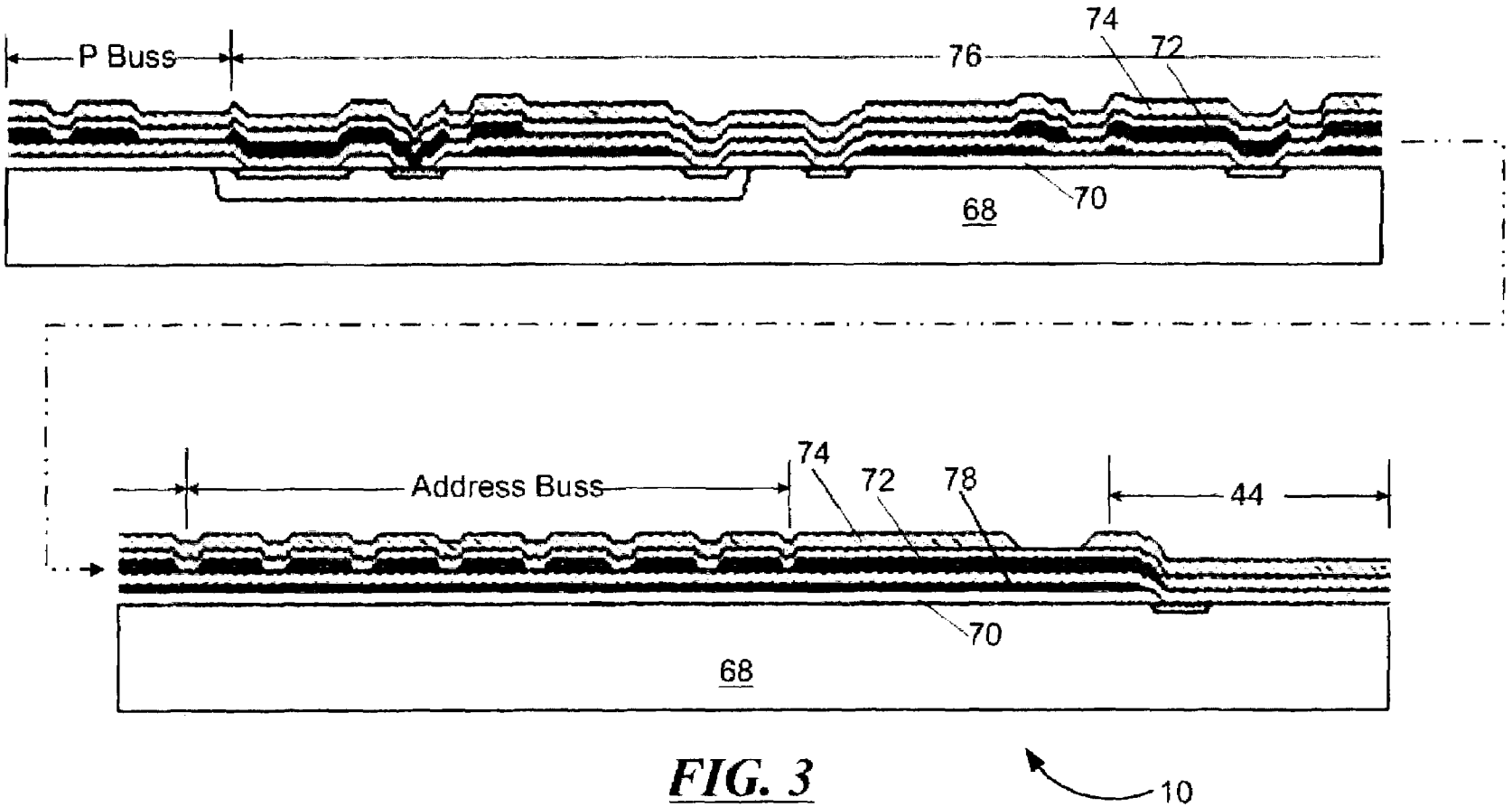
FIG. 3 is a cross-sectional view, not to scale, of a portion of a semiconductor substrate for a micro-fluid ejection head.

A cross-sectional view, not to scale, of a portion of the substrate 10 is illustrated in FIG. 3. As illustrated in FIG. 3, the semiconductor substrate 10 includes a silicon substrate 68 having a dielectric layer 70 provided between the substrate 68 and device layers on the surface 20 of the substrate 10. A first metal conductor layer 72 provides power and ground interconnections for logic devices 76. Ejection actuator 26 is preferably a heater resistor provided between anode and cathode conductors 72A and 72B (FIG. 5) provided by a first metal conductor layer 72. The first metal conductor layer 72 also provides interconnection between the ejection actuator 26 and the power transistor 44. In the illustration of FIG. 3, the power transistor 44 is a field effect transistor (FET). Control logic for the power transistor 44 is provided by logic devices 76 which may be interconnected with the power transistor 44 using a polysilicon interconnection layer 78. A second metal conductor layer 74 provides a ground buss and a power buss, as described in more detail below, over the P buss, logic devices 76, address buss, and FET 44.

Figure 4:
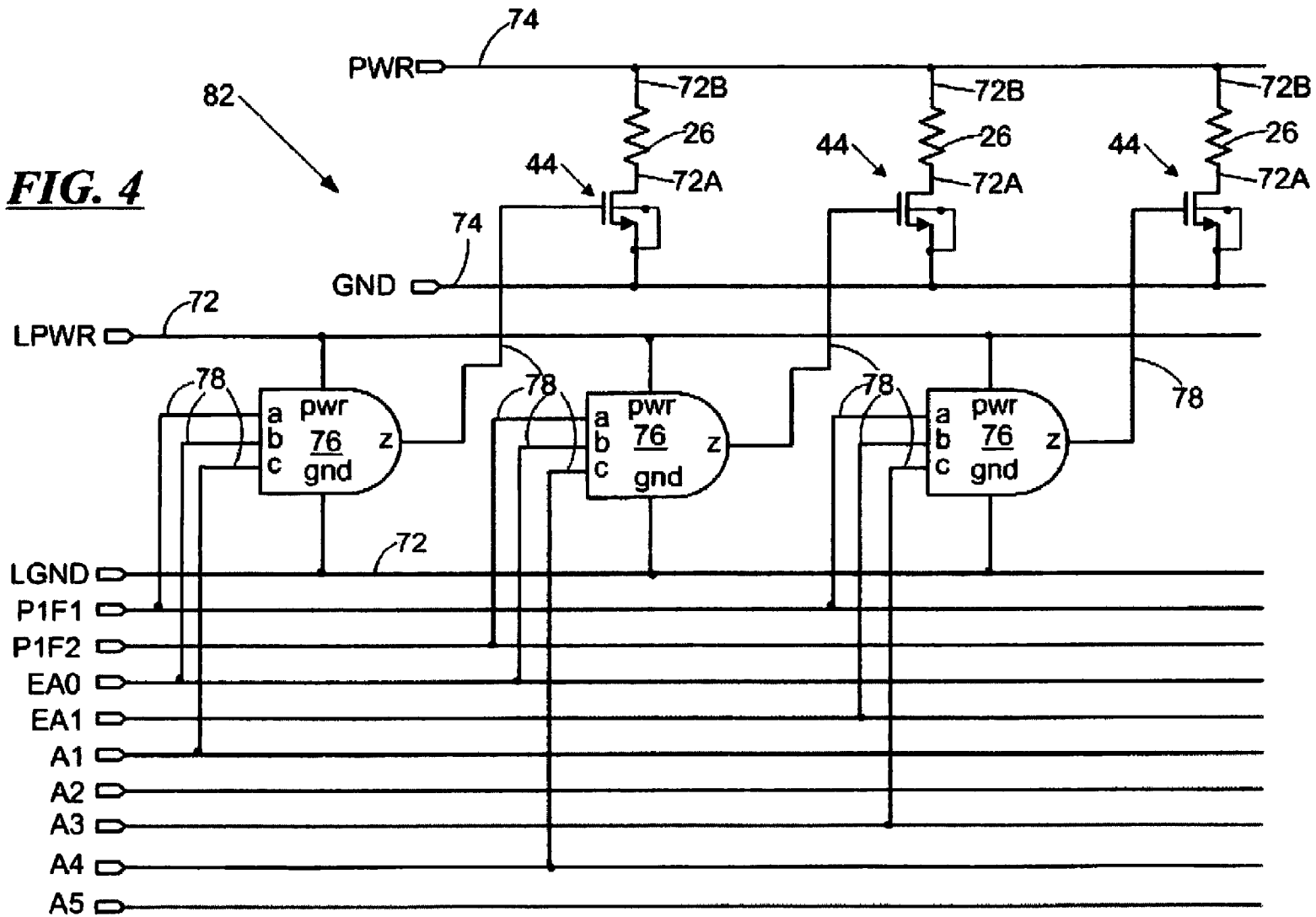
FIG. 4 is a schematic diagram of a portion of a circuit for a micro-fluid ejection head according to the disclosure.

FIG. 4 is a schematic diagram of a portion of a circuit 82 for the ejector actuators 26. As shown in FIG. 4, the first metal conductor layer 72 provides power and ground connections to control devices 76. The polysilicon layer 78 provides interconnection between address busses P1F1-P1F2, EA0-EA1 and A1-A5 and interconnection between the control devices 76 and the FET's 44. The second metal conductor layer 74 provides the power and ground connections to the FET 44 and to the anode and cathode conductors 72A and 72B for the ejection actuator 26.

Figure 5:
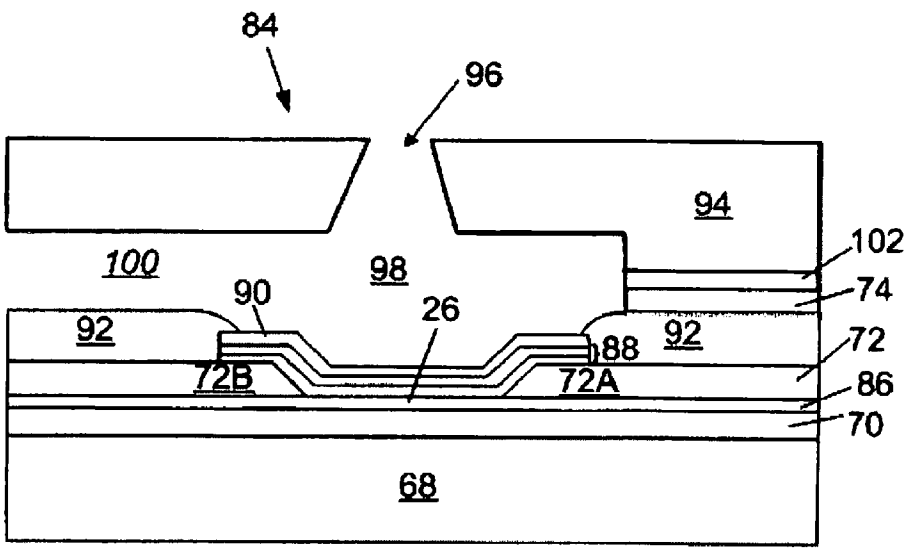
FIG. 5 is a cross-sectional view, not to scale, of a portion of a micro-fluid ejection head according to the disclosure.

A portion of a micro-fluid ejection head 84 is illustrated in FIG. 5. The micro-fluid ejection head 84 includes the silicon substrate 68, the dielectric layer 70, made of silicon dioxide, phosphorus doped glass (PSG) or boron and phosphorus doped glass (BSPG) deposited or grown on the silicon substrate 68. The dielectric layer 70 has a thickness ranging from about 8,000 to about 30,000 Angstroms. The silicon substrate 12 typically has a thickness ranging from about 100 to about 800 microns or more.

A resistive layer 86 is deposited on the epitaxial layer 70. The resistive layer 86 may be selected from TaAl, $Ta_2N$, TaAl(O,N), TaAlSi, TaSiC, Ti(N,O), WSi(O,N), TaAlN and TaAl/Ta and has a thickness ranging from about 500 to about 1,500 Angstroms.

The first metal conductive layer 72 is deposited on the resistive layer 86 and is etched to provide anode and cathode conductors 72A and 72B for a heater resistor 26 defined between the anode and cathode conductors 72A and 72B. The first metal conductive layer 72 may be selected from conductive metals, including but not limited to, gold, aluminum, silver, copper, and the like and has a thickness ranging from about 4,000 to about 15,000 Angstroms.

A passivation layer 88 is deposited on the heater resistor 26 and a portion of conductive layer 72 to protect the heater resistor 26 from fluid corrosion. The passivation layer 88 typically consists of composite layers of silicon nitride (SiN) and silicon carbide (SiC) with SiC being the top layer. The passivation layer 88 has an overall thickness ranging from about 1,000 to about 8,000 Angstroms.

A cavitation layer 90 is then deposited on the passivation layer 88 overlying the heater resistor 26. The cavitation layer 90 has a thickness ranging from about 1,500 to about 8,000 Angstroms and is typically composed of tantalum (Ta). The cavitation layer 90, also referred to as the "fluid contact layer" provides protection of the heater resistor 26 from erosion due to bubble collapse and mechanical shock during fluid ejection cycles.

Overlying the anode and cathode conductors 72A and 72B is another insulating layer or dielectric layer 92 typically composed of epoxy photoresist materials, polyimide materials, silicon nitride, silicon carbide, silicon dioxide, spun-on-glass (SOG), laminated polymer and the like. The layer 92 preferably has a thickness ranging from about 5,000 to about 20,000 Angstroms. The dielectric layer 92 provides electrical insulation between the first metal conductor layer 72 and the second metal conductor layer 74.

In FIG. 5, a nozzle plate 94 containing nozzle holes 96, fluid chambers 98, fluid flow channels 100 are formed in the nozzle plate 94. The fluid chambers 98 and fluid flow channels 100 are in flow communication with the fluid supply slot 14, 16, or 18. The nozzle plate 94 is adhesively attached to the device surface 20 of the substrate 10 as by means of adhesive 102.

Figure 6:
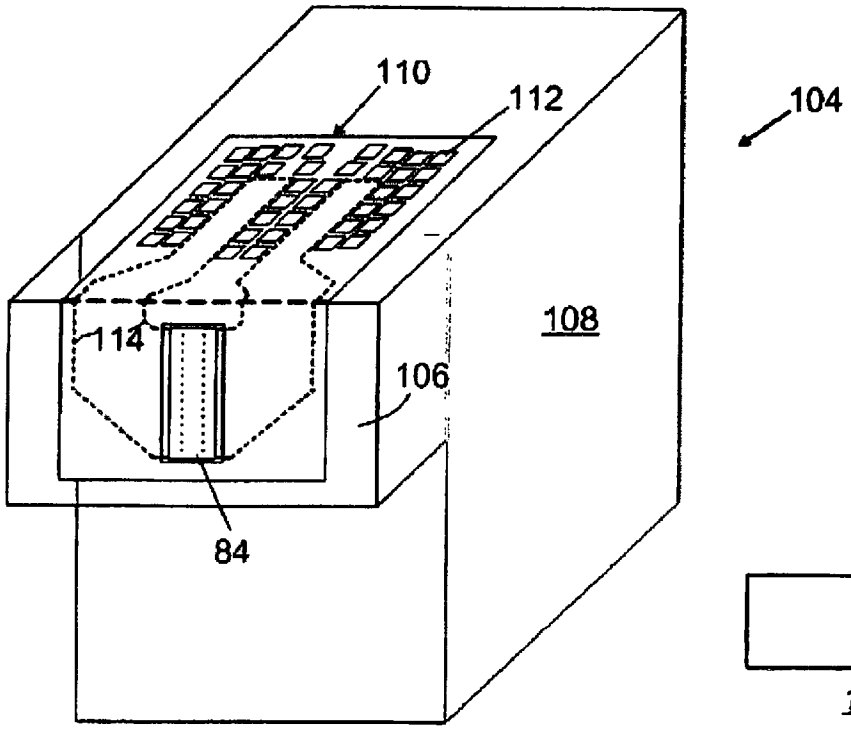
FIG. 6 is a perspective view, not to scale, of a cartridge containing a micro-fluid ejection head according to the disclosure.

A fluid supply cartridge 104 containing the ejection head 84 is illustrated in FIG. 6. The micro-fluid ejection head 84 is attached to an ejection head portion 106 of the fluid cartridge 104. A main body 108 of the cartridge 104 includes a fluid reservoir for supply of fluid to the micro-fluid ejection head structure 84. A flexible circuit or tape automated bonding (TAB) circuit 110 containing electrical contacts 112 for connection to a control device such as the printer is attached to the main body 108 of the cartridge 104. Electrical tracing 114 from the electrical contacts 112 are attached to the contact pads 40 (FIG. 1) on the substrate 10 to provide activation of the ejection actuators 26 on demand from the control device to which the fluid cartridge 104 is attached. The disclosure, however, is not limited to the fluid cartridge 104 described above as the micro-fluid ejection head 84 may be used in a wide variety of fluid cartridges, wherein the ejection head 84 may be remote from the fluid reservoir of the main body 108.

As set forth above, there are two metal conductor layers, i.e., the first metal conductor layer 72 and the second metal conductor layer 74, and a polysilicon layer 78 providing interconnection between the ejection actuators 26, power transistor 44 and device logic 76 on the surface 20 of the substrate 10. In a prior art design, the second metal conductor layer 74 provided power busses 120 and the first metal conductor layer 72 provided the ground buss 122 as illustrated in FIG. 7.

Figure 7:
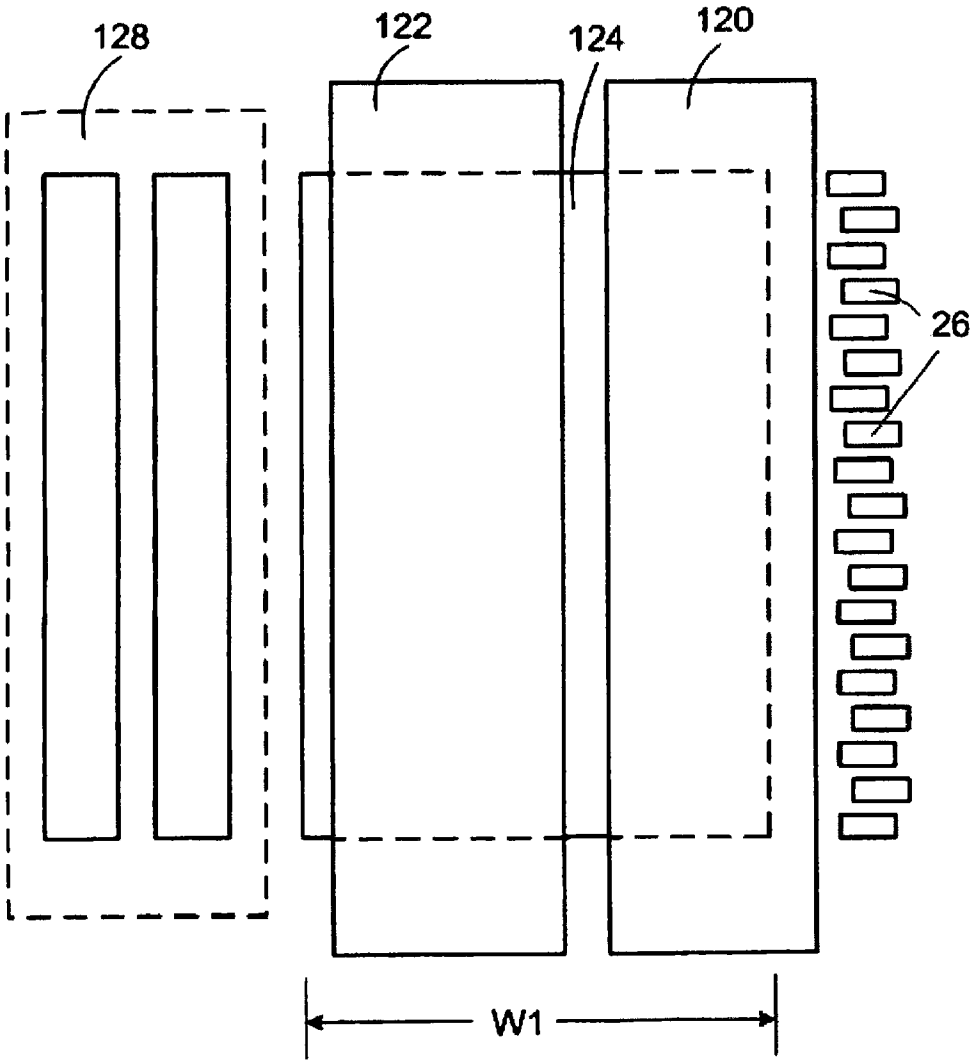
FIG. 7 Prior Art
FIG. 7 is a block diagram of a plan view of a prior art semiconductor substrate.

In the prior art design shown in FIG. 7, the power buss 120 is disposed over a portion of an active area 124 of the columnar array of power transistors 48, 50, or 52 (FIG. 1). The ground buss 122 is also routed over a portion of the active area 124 of the columnar array of power transistors 48, 50, or 52.

In this case, the active area 124 has a width W1 ranging from about 400 to about 1000 microns. Area 128 in FIG. 6 represents the control logic array 58, 60, or 62 (FIG. 1). Accordingly, the overall width WS of the substrate 10 ranges from about three millimeters to about six millimeters in order to provide surface 20 sufficient for the ejection actuator arrays 30, 32, or 34, power transistor arrays 48 50, or 52 and control logic arrays 58, 60, or 62 as well as contact pads 40 and conductor routing for the power and ground busses 120 and 122. The foregoing description also applies to substrate 12 (FIG. 2).

Figure 8:
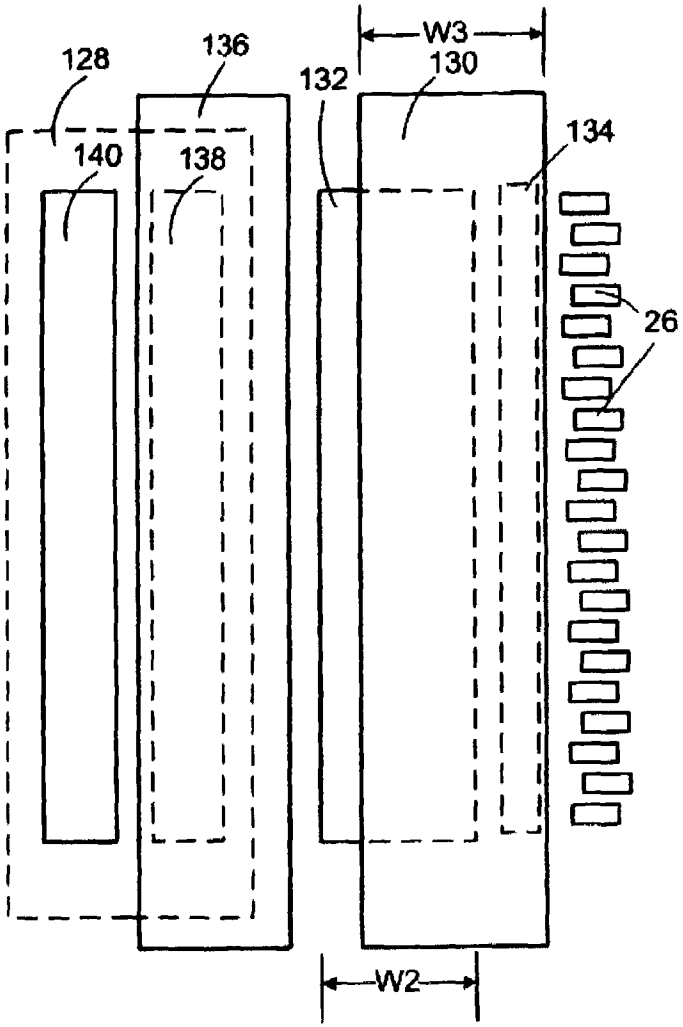
FIGS. 8 and 9 are block diagrams of plan views of semiconductor substrates according to embodiments of the disclosure.
Figure 9:
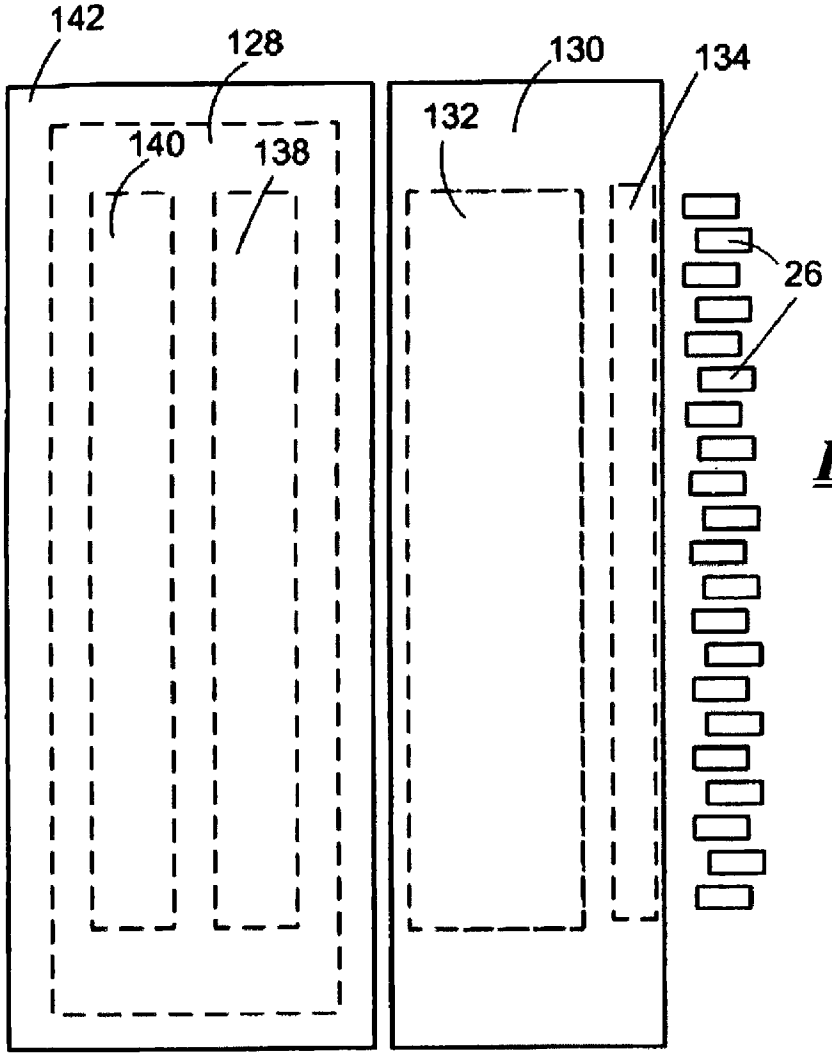

As the resistance of the ejection actuators 26 increases for improved micro-fluid ejection heads 84, the size of the power transistors 44 or 46 is reduced. In order to provide sufficiently sized metal conductors for the power and ground busses without increasing the width WS of the substrate 10, the power and ground busses may be routed as illustrated in FIGS. 8 and 9. In FIG. 8, a power buss 130 is routed over at least a portion of an active area 132 for the power transistor array 48, 50, or 52. In this example, the active area 132 has a width W2 ranging from about 50 to about 400 microns. In order to increase a width W3 of the power buss 130 in the second metal conductive layer 74, the power buss 130 may also overly a columnar array 134 of temperature sense resistors (TSR) disposed between the fluid ejection devices 26 and the active area 132 of the power transistor array 48, 50, or 52.

In the embodiment illustrated in FIG. 8, the ground buss 136 is disposed adjacent the power buss 130 in the second metal conductive layer 74, however, the ground buss 136 overlies at least a portion of the control logic area 128. For example, the control logic area 128 may include active capacitors, arrays of select logic cells (predrive) 138 that select the gate of the power transistors 44 to activate the ejection devices 26, primitive (P), address (A), and extended address (EA) buss lines, control buss lines, pdata register arrays 140, and the like.

It will be appreciated that since the width W2 of the active area 132 of the power transistor array 48, 50, or 52 is significantly smaller than the width W1 of the active area 124 (FIG. 8), the overall width WS of the substrate 10 may be made smaller provided the power and ground busses 130 and 136 in the second metal conductive layer 74 are made to overly the active area 132 and control logic area 128 as shown in FIG. 8.

In an alternative embodiment, illustrated in FIG. 9, power buss 130 overlies the active area 132 of the power transistors 48, 50, or 52 and overlies the columnar array 134 of temperature sense resistors (TSR). A larger ground buss 142 overlies the control logic area 128.

One of the unique aspects of the foregoing embodiments is the ability to route the ground buss 136 or a ground buss 142 over all or a portion of the control logic area 128 for the power transistors 44 while still using only two metal conductor layers 72 and 74 as described above. Such aspects may be achieved by carefully routing the control logic arrays 58, 60, or 62 only in the first metal conductor layer 72 using the polysilicon interconnections 78 between the control logic arrays 58, 60, and 62 and the power transistor arrays 48, 50, or 52. Since only the control logic interconnections 78 are routed in polysilicon, there may be no noticeable adverse pulse timing effect for firing the ejection actuators 26. Use of polysilicon interconnections 78 enables an increase in area that may be used for routing the ground and power busses in the second metal conductor layer 74.

Another unique aspect of the disclosed embodiments is the use of a non-metal TSR material for the TSR arrays 134 thus enabling the power buss 130 to be routed in the second metal conductor layer 74 over the TSR arrays 134. Accordingly, all conductor routing is in no more than two metal conductor layers.

It is contemplated, and will be apparent to those skilled in the art from the preceding description and the accompanying drawings, that modifications and changes may be made in the embodiments of the disclosure. Accordingly, it is expressly intended that the foregoing description and the accompanying drawings are illustrative of preferred embodiments only, not limiting thereto, and that the true spirit and scope of the present disclosure be determined by reference to the appended claims.

What is claimed is:

1. A method for reducing a width of a substrate for a micro-fluid ejection device, the method comprising the steps of:

providing at least one fluid supply slot in a substrate;

forming a plurality of micro-fluid ejection actuators in a columnar array on a device surface of the substrate adjacent the fluid supply slot;

forming a plurality of power transistors in a columnar array adjacent the ejection actuators, the power transistors occupying a power transistor area of the substrate and being interconnected to the ejection actuators in a first metal conductor layer;

forming a columnar array of logic circuits adjacent the power transistors, the logic circuits occupying a logic circuit area of the substrate and being interconnected to the power transistors in a polysilicon conductor layer; and depositing a second metal layer on the substrate to provide a power buss and a ground buss to the ejection actuators, wherein the power buss overlaps at least a portion of the power transistor active area and the ground buss overlaps at least a portion of the logic circuit area.

2. The method of claim 1, wherein the micro-fluid ejection actuators comprise heater resistors.

3. The method of claim 1, wherein the substrate is provided with multiple fluid supply slots.

4. The method of claim 1, further comprising forming a columnar array of temperature sense resistors between the columnar array of power transistors and the columnar array of ejection actuators.

5. The method of claim 4, wherein the temperature sense resistors are formed from a non-metal material.

6. The method of claim 4, wherein the power buss overlaps the temperature sense resistors.

7. The method of claim 6, wherein the power buss overlaps the power transistor area of the substrate.

8. The method of claim 1, wherein the logic circuits comprise circuits selected from the group consisting of primitive address logic, predrive circuits, data registers, and combinations of two or more of the foregoing.

9. The method of claim 8, wherein the ground buss overlaps the logic circuit area of the substrate.

* * * * *